US010184281B2

(12) United States Patent
Van Parys

(10) Patent No.: US 10,184,281 B2
(45) Date of Patent: Jan. 22, 2019

(54) CONCEALED HINGE FOR A TURN-TILT WINDOW AND TILT-TURN WINDOW AND WINDOW EQUIPPED THEREWITH

(71) Applicant: Emmanuel Van Parys, Wortegem/Petegem (BE)

(72) Inventor: Emmanuel Van Parys, Wortegem/Petegem (BE)

( * ) Notice: Subject to any disclaimer, the term of this patent is extended or adjusted under 35 U.S.C. 154(b) by 30 days.

(21) Appl. No.: 15/399,114

(22) Filed: Jan. 5, 2017

(65) Prior Publication Data

US 2017/0198508 A1 Jul. 13, 2017

(30) Foreign Application Priority Data

Jan. 7, 2016 (BE) ..... 2016/5005

(51) Int. Cl.
*E05D 15/52* (2006.01)
*E05D 3/16* (2006.01)

(52) U.S. Cl.
CPC ..... *E05D 15/5211* (2013.01); *E05D 15/5205* (2013.01); *E05D 15/5214* (2013.01); *E05D 2003/166* (2013.01); *E05Y 2900/148* (2013.01)

(58) Field of Classification Search
CPC ..... E05D 15/30; E05D 15/44; E05D 15/52; E05D 15/5205; E05D 15/5211; E05D 15/5214; E05D 3/16; E05D 2003/166; E05Y 2900/148
See application file for complete search history.

(56) References Cited

U.S. PATENT DOCUMENTS 3,838,537 A * 10/1974 Stavenau ..... E05D 15/44 16/354
3,911,621 A * 10/1975 McHeffey ..... E05D 15/5205 49/192
3,994,093 A * 11/1976 Mayer ..... E05D 15/52 49/192
4,301,622 A * 11/1981 Dunsmoor ..... E05D 15/30 49/249
4,674,149 A * 6/1987 Vetter ..... E05D 15/30 16/341
4,718,144 A * 1/1988 Buckley ..... E05D 15/44 16/341
4,928,428 A * 5/1990 Gebhardt ..... E05D 15/52 49/192

(Continued)

FOREIGN PATENT DOCUMENTS

BE 1017348 A2 6/2008

*Primary Examiner* — Justin B Rephann
(74) *Attorney, Agent, or Firm* — Young & Thompson

(57) ABSTRACT

A concealed hinge for a turn-tilt window with a fixed frame and a leaf is provided with a scissor mechanism with a main arm having at a first end a hinge for fastening the concealed hinge to the top of the leaf, and is hingeably connected at a second end to a scissor hinge that is intended for the connection to the frame. The scissor hinge is composed of two scissor arms that are hingeable with respect to one another in such a way that the concealed hinge can be folded up. The main arm and the scissor arms extend above one another and parallel to one another in a horizontal direction. In the folded-up situation of the concealed hinge, when viewed vertically the main arm, with a section at the second end, is located above at least one of the scissor arms of the scissor hinge.

20 Claims, 11 Drawing Sheets

(56) References Cited

U.S. PATENT DOCUMENTS 4,942,694 A * 7/1990 Simoncelli ..... E05D 15/5211 49/192
5,037,230 A * 8/1991 Aumercier ..... E05D 15/5205 403/53
5,081,741 A * 1/1992 Aumercier ..... E05D 15/30 16/238
5,226,256 A * 7/1993 Fries ..... E05B 47/0012 49/13
6,314,681 B1 * 11/2001 Moody ..... E05D 15/30 49/343
6,431,620 B2 * 8/2002 Tremblay ..... E05C 9/185 292/263
7,013,604 B1 * 3/2006 Moody ..... E05C 9/10 49/341
7,644,538 B2 * 1/2010 Balbo Di Vinadio .. E05C 9/063 49/192
7,690,154 B2 * 4/2010 Muir ..... E05D 15/44 49/246
8,418,404 B2 * 4/2013 Gramstad ..... E05C 17/24 49/141
8,528,255 B2 * 9/2013 Lambertini ..... E05C 9/063 49/192
9,512,657 B2 * 12/2016 Yeung ..... E06B 3/5018
9,512,658 B2 * 12/2016 Balbo Di Vinadio ..... E05D 15/44
2002/0100233 A1 * 8/2002 Van Parys ..... E05C 9/20 52/204.51
2005/0022941 A1 * 2/2005 Di Vinadio ..... E05C 9/20 160/15
2005/0283947 A1 * 12/2005 Balbo Di Vinadio ..... E05D 15/5211 16/360
2005/0284025 A1 * 12/2005 Balbo Di Vinadio ..... E05D 15/5205 49/246
2006/0080911 A1 * 4/2006 Diekmann ..... E05D 3/18 52/204.1
2006/0207182 A1 * 9/2006 Van Parys ..... E05D 15/5208 49/192
2008/0016778 A1 * 1/2008 Muir ..... E05D 5/0215 49/345
2008/0040978 A1 * 2/2008 Diekmann ..... E05F 15/619 49/252
2009/0183449 A1 * 7/2009 Emiel ..... E05D 15/52 52/210
2012/0174487 A1 * 7/2012 Lambertini ..... E05F 11/10 49/353
2018/0002963 A1 * 1/2018 Lambertini ..... E05D 15/5211

* cited by examiner

CONCEALED HINGE FOR A TURN-TILT WINDOW AND TILT-TURN WINDOW AND WINDOW EQUIPPED THEREWITH

BACKGROUND OF THE INVENTION

Field of the Invention

The present invention relates to a concealed hinge for a window with a fixed frame and a turnable leaf.

In particular the invention relates to a concealed hinge for a turn-tilt and a tilt-turn window that can turn open around a vertical axis and tilt open around a horizontal axis depending on the position of the operating handle of the window.

Description of the Related Art

The leaf of the window is traditionally provided on its outer periphery with a fitting groove in which fitting slats are movably affixed, whereby these fitting slats can be moved in the one or the other direction by means of the aforementioned operating handle.

As is known, the window is provided with a number of locking points in the form of locking pins that are fastened to the fitting slats and which can engage with locking pieces on the inside of the fixed frame in order to lock the leaf in the closed position of the operating handle by hooking the locking pins in or behind the locking pieces, or to unlock the leaf by withdrawing the locking pins out of or behind the locking pieces by turning the operating handle in a suitable direction of rotation from the closed position.

When turning the operating handle in the aforementioned direction of rotation, either the window can first be brought to the turn position and with further turning of the operating handle it can then be brought to the tilt position, or first brought to the tilt position and only then to the turn position. In the first case it is called a turn-tilt window and in the second case a tilt-turn window. The present invention applies to both types of window. In the following, a turn-tilt window also means a tilt-turn window.

A concealed hinge is known in BE 1.017.348 that is mounted on the top of the window between the top horizontal profile of the fixed frame and the top of the leaf, and which is provided with a scissor mechanism with a main arm that is connected by a first end to the leaf by means of a hinge that is affixed on a carriage that is movably affixed in a guide, whereby this guide is intended to be fastened to the leaf across the fitting groove on the top of the leaf, so that a fitting slat can move thereunder that is provided with a locking piece that can engage with a locking pin on the main arm to be able to block or unblock the scissor mechanism with respect to the leaf by using the operating handle.

In the blocked situation of the scissor mechanism the leaf can turn open, while in the unblocked situation the leaf can tilt open.

It is also known in BE 1.017.348 that the main arm of the concealed hinge is coupled by its other second end to a scissor hinge with two scissor arms that are hingeable with respect to one another, whereby the scissor arms are hingeably connected by one end to the main arm, and are hingeably connected by their other end to a mounting slat with which the scissor mechanism can be fastened to the inside of the top horizontal profile of the fixed frame.

In the closed position of the window, the concealed hinge is folded up and the scissor arms of the scissor hinge, together with the mounting slat and the free end of the main arm of the scissor mechanism, are folded up above one another in the limited space between the fitting grooves of the leaf and the fixed frame in the corner of the window on the hinge side of the window.

The main arm is thereby logically mounted under the scissor arms by its second end, in other words by the end closest to the top of the leaf and thus the furthest from the mounting slat.

In order to provide as much space as possible under the main arm for the guide with carriage on the leaf, the main arm is provided with a double kink that divides the main arm into two sections that are located at a different height with respect to the mounting slat, respectively a higher first section that extends above the aforementioned guide and is connected thereto, and a lower second section with which the main arm is connected to the scissor hinge.

The double kink is such that the thickness of the two scissor arms is bridged, such that, in the mounted and folded-up situation of the concealed hinge, the higher first section of the main arm is approximately at the same height as the second scissor arm, that is situated the closest to the mounting slat.

As a result of this kink, in combination with the relatively large load of the main arm due to the relatively large weight of the glass, there is the risk that during tilting open and closing the main arm experiences relatively large bending, which can only be resolved by strengthening the main arm, however where there is little space for this in view of the limited clear space between the leaf and the fixed frame.

As a result of this limited space it is also difficult to provide an extra locking point at the location of the scissor hinge, except with a relatively complex and expensive solution. That is why an extra locking point is often not provided at this location, which is to the detriment of the seal of the window against wind and water.

SUMMARY OF THE INVENTION

The purpose of the present invention is to provide a solution to one or more of the aforementioned and other disadvantages.

To this end the invention concerns a concealed hinge for a turn-tilt and tilt-turn window with a fixed frame and a leaf, whereby the concealed hinge is provided with a scissor mechanism with a main arm, of which a first section is provided at a first end with a hinge for fastening the concealed hinge to the top of the leaf, and of which a second section is hingeably connected at the other end to a scissor hinge that is intended for the hingeable connection of the main arm to the fixed frame, whereby this scissor hinge is composed of at least two scissor arms that are hingeable with respect to one another in such a way that the concealed hinge can be folded up to a folded-up situation, whereby the main arm and the scissor arms extend above one another and essentially parallel to one another in a horizontal direction, with the characteristic that in the aforementioned folded-up situation of the concealed hinge, when viewed vertically the main arm with the aforementioned second section at its second end is located between two of the at least two scissor arms.

As a result of the higher location of the main arm, or at least the second section with which the main arm is mounted above at least one scissor arm and between two of the at least two scissor arms, it is possible to preserve the same clear height between the top of the leaf and the first section of the main arm with which the main arm is connected to the leaf, with a less pronounced double kink, as with the double kink a smaller height difference has to be bridged than in the known case where the main arm is located under the hinge arms, or even without a double kink.

Thanks to this less pronounced kink, when the hinge is loaded there will be less bending of the main arm and the leaf will also adopt a more stable position in the event of greater weights of the leaf.

In other words a more favourable equilibrium of forces is obtained.

The configuration of the hinge points and their mutual location is chosen such that with a minimum of cutaways in the main arm and in the hinge arms, sufficient space can be made for the different hinge points in the folded-up situation of the concealed hinge when the main arm and the hinge arms are located above and over one another.

The chosen configuration also enables an additional locking point to be provided in a simple way in the corner of the window on the hinge side of the leaf, which is beneficial with regard to the seal of the window against water and wind.

This additional locking point is preferably realised by providing the first scissor arm, along its front edge, with a longitudinal protruding finger that can engage with a locking peg that is provided on a locking slat that passes under the aforementioned guide or on an extension piece of this locking slat.

The invention also relates to a turn-tilt window or a tilt-turn window with a fixed frame and a turnable leaf therein, whereby the window is provided with a concealed hinge according to the invention and whereby the guide is fastened to the top of the leaf and the mounting slat is mounted in an inside corner of the fixed frame against the inside of the top horizontal profile of the fixed frame.

BRIEF DESCRIPTION OF THE DRAWINGS

With the intention of better showing the characteristics of the invention, a preferred embodiment of a concealed hinge for a turn-tilt or tilt-turn window, and such a window equipped therewith, is described hereinafter by way of an example without any limiting nature, with reference to the accompanying drawings, wherein.

DESCRIPTION OF THE PREFERRED EMBODIMENTS

Figure 1:
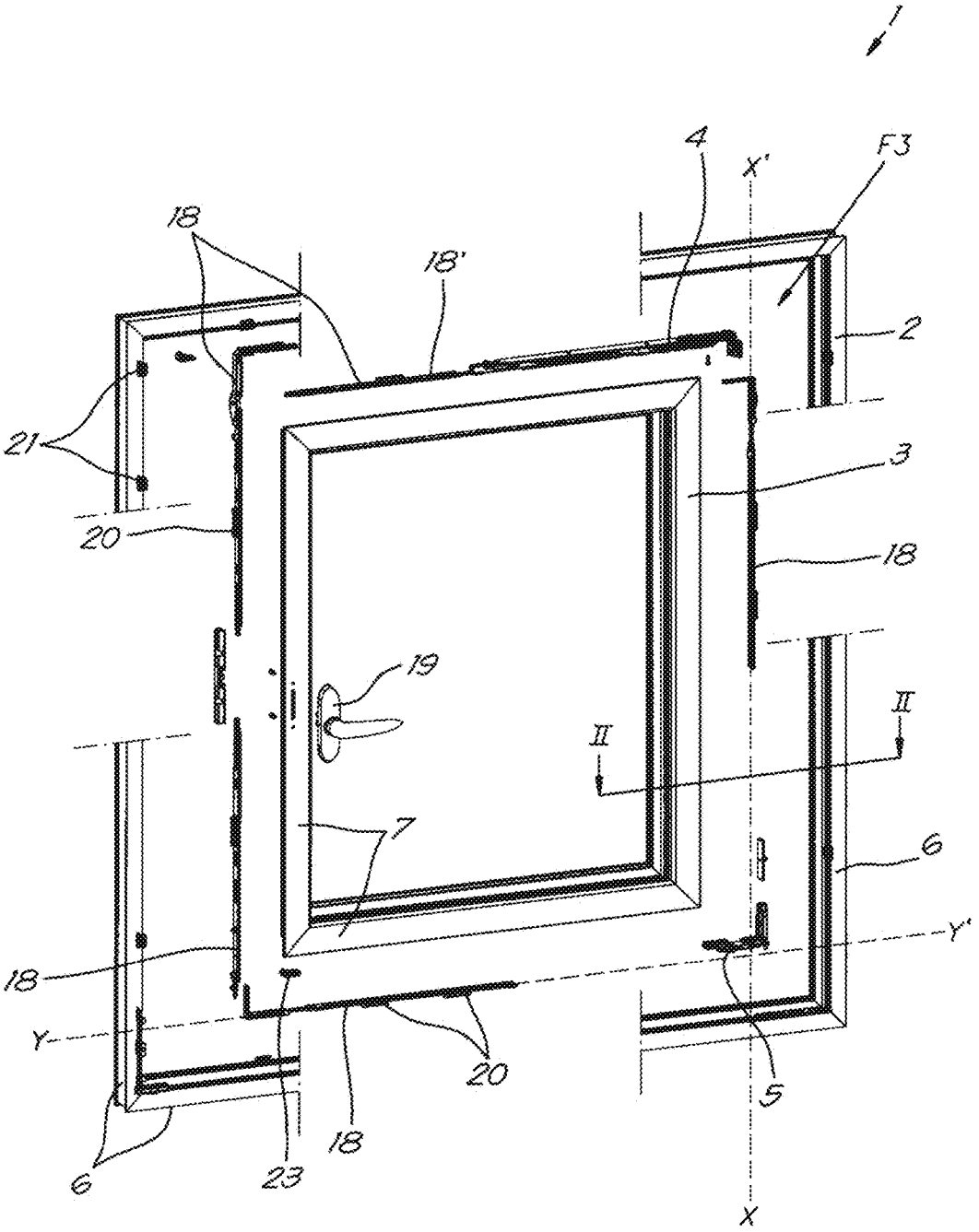
FIG. 1 schematically shows a perspective view of a turn-tilt window with a concealed hinge according to the invention.

The turn-tilt window 1 chosen as an example in FIG. 1 comprises a fixed frame 2 and a leaf 3 that is turnably and tiltably suspended in the fixed frame by means of two concealed hinges, respectively a concealed hinge 4 on the top of the leaf 3 and a concealed hinge 5 according to the invention on the underside thereof.

Figure 2:
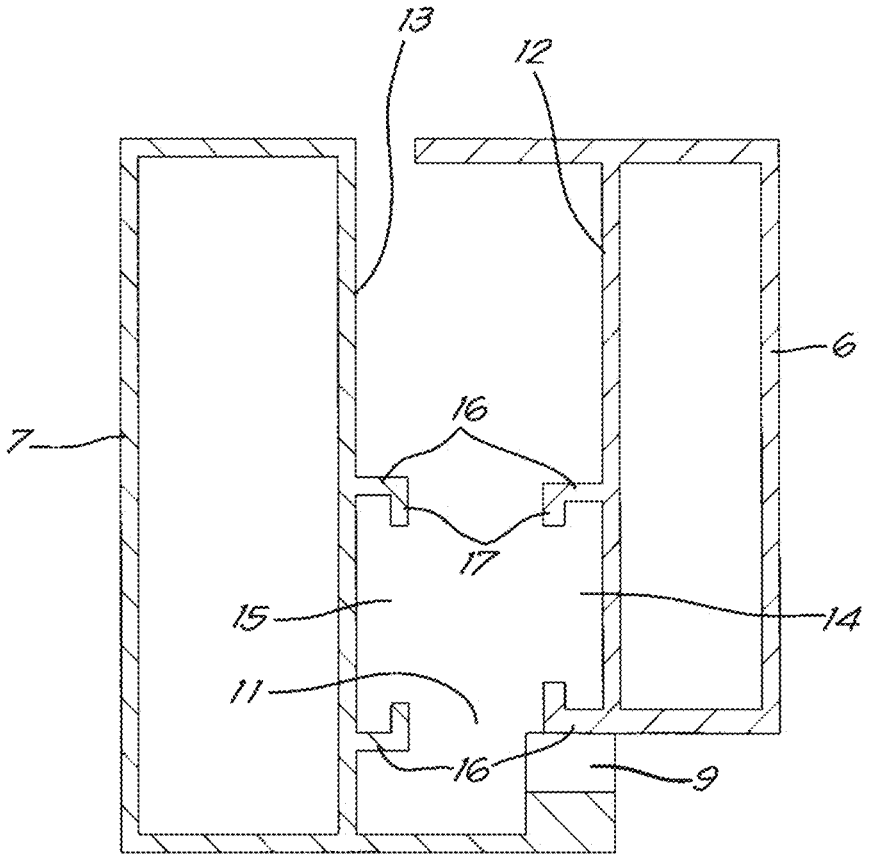
FIG. 2 shows a cross-section according to line II-II of FIG. 1.

The fixed frame 2 and the leaf 3 are constructed of profiles 6 and 7, of which the leaf profiles 7 are provided with a sideways protruding leaf lip 8 which, due to the intervention of a seal 9, as shown in FIG. 2 in the case of a closed window, rests against the front 10 of the fixed frame 2 and partially overlaps this front 10 and also covers the gap 11 between the frame 2 and the leaf 3 in the front view.

On the sides 12 and 13 of the frame 2 and the leaf 3 oriented towards one another, respectively along the inner periphery of the frame 2 and along the outer periphery of the leaf 3, fitting grooves 14 and 15 are provided in a known way opposite one another that extend along the inner periphery of the frame 2 and along the outer periphery of the leaf 3 and which are formed by upright ribs 16 that are folded inwards perpendicularly at their free end 17.

The aforementioned concealed hinges 4 and 5 are mounted between the fitting grooves 14 and 15 on the sides 12 and 13 of the frame 2 and the leaf 3 oriented towards one another, and are concealed from view therein behind the lip 8 when the window 1 is closed. Hence the name of concealed hinge, although this also means all separate hinges 4 and 5 that are intended to be mounted in this concealed way, without already being mounted, however.

In the example shown the leaf 3 is also equipped with fitting slats 18 that are movably affixed in the fitting groove 15, and with an operating handle 19 to move the fitting slats 18 in the one or the other direction in the fitting grooves 15 by turning the operating handle 19.

The fitting slats 18 are provided with locking pins 20 that can engage with corresponding locking pieces 21 on the inner periphery of the frame 2 to be able to lock the window 1 in the closed position by a suitable turn of the operating handle 19.

Front, back, frontal, etc, and other directional indications are viewed from the perspective of somebody at the front of the window 1 with the operating handle 19 and who is facing the window 1.

Figure 3:
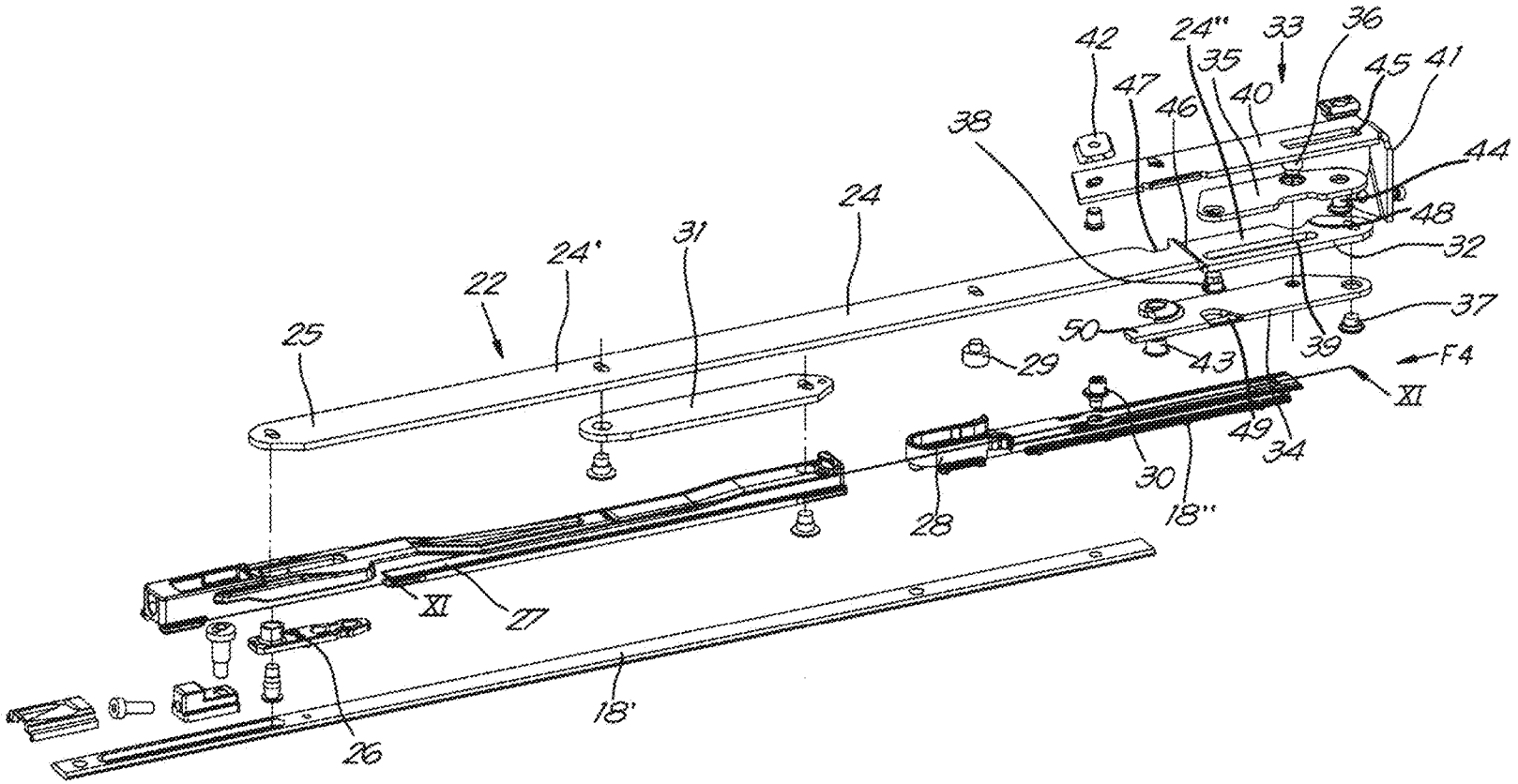
FIG. 3 shows an exploded view of the concealed hinge that is indicated by arrow F3 in FIG. 1.

The top concealed hinge 4 is, as shown in FIG. 3, provided with a scissor mechanism 23, which, as is known, is blocked in a closed position with respect to the leaf 3 by turning the operating handle 19 to a turn position.

In this turn position, the top concealed hinge 4 can act as a hinge that, together with the bottom hinge 5, enables a turning movement of the leaf 3 around a vertical axis X-X'.

By further turning the operating handle 22 to a tilt position, the scissor mechanism 22 of the top concealed hinge 4 can be unblocked, while simultaneously an additional tilt hinge 23 is operated on the handle side of the leaf, whereby this additional tilt hinge 24 together with the bottom concealed hinge 5 enables a tilting movement of the leaf 3 around a horizontal axis Y-Y'.

In this way, the bottom concealed hinge 5 fulfils a dual function, in the case of a tilt-turn window, i.e. that of a vertical turn hinge and that of a horizontal tilt hinge, depending on whether the position of the operating handle 19 is placed in a turn position or a tilt position.

The changeover from the turn position to the tilt position is, as explained, brought about by blocking or unblocking the scissor mechanism 22 with respect to the leaf 3 by moving the top fitting slat 18' on the top horizontal profile 7 of the leaf 3, whereby this fitting slat 18' continues under the scissor mechanism 22.

Figure 4:
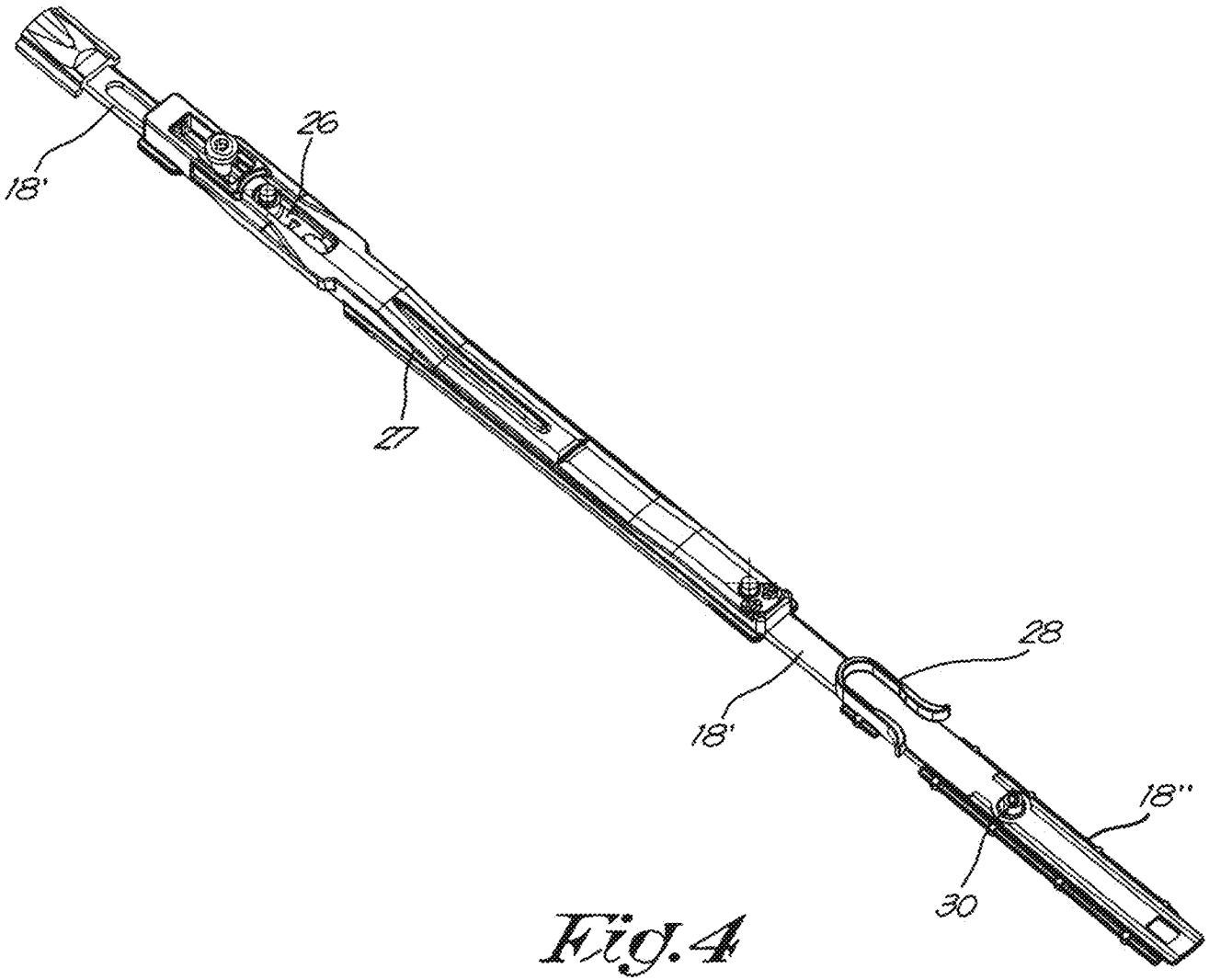
FIG. 4 shows the section that is indicated by F4 in FIG. 3, but in an assembled state.
Figure 5:
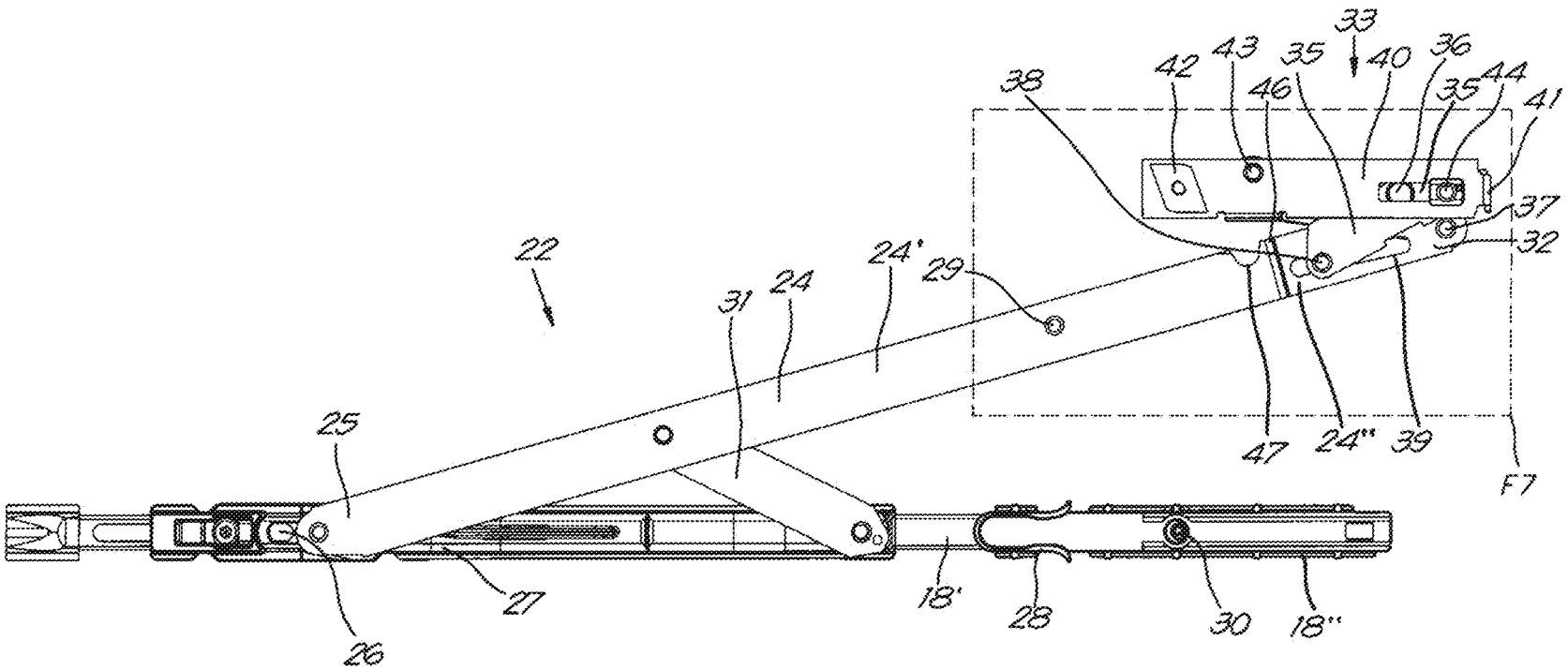
FIG. 5 shows a top view of the concealed hinge of FIG. 3 in an assembled state and in an open position.
Figure 6:
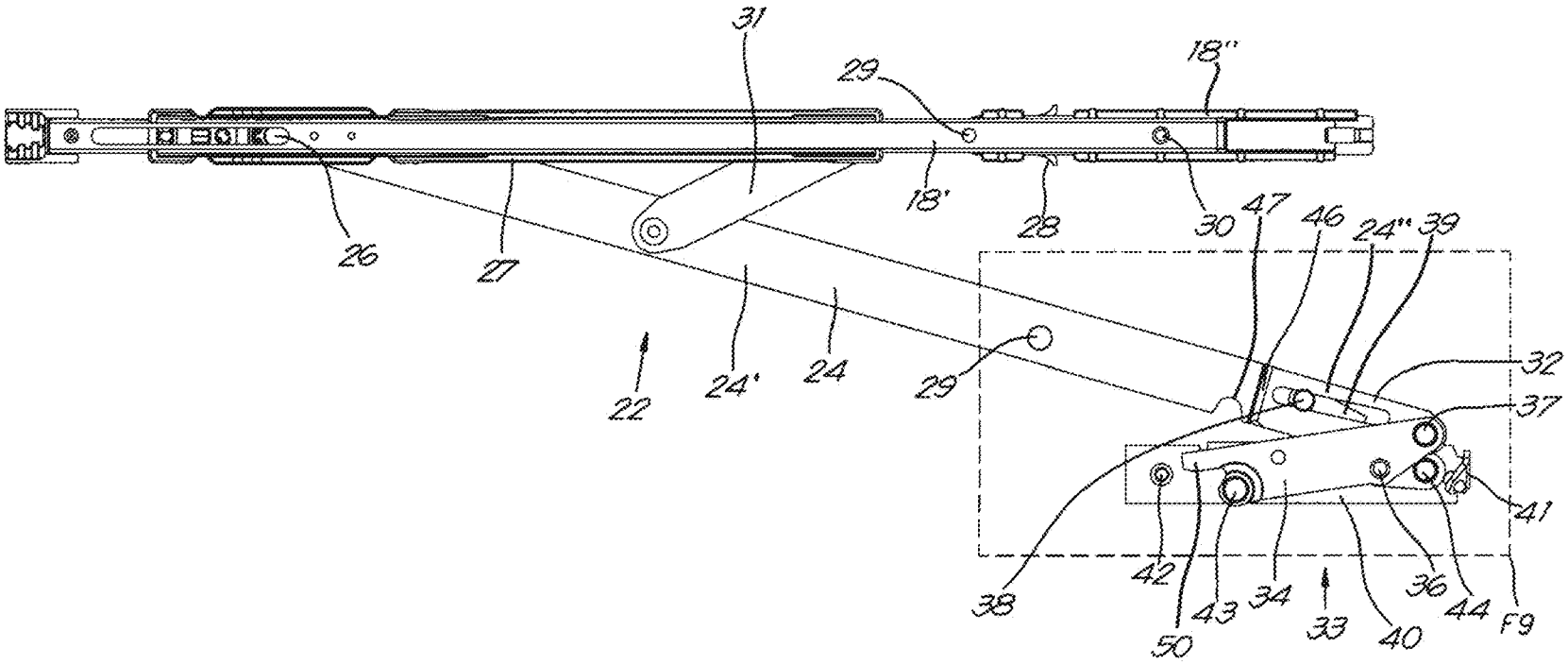
FIG. 6 shows a bottom view of the concealed hinge of FIG. 5.
Figure 7:
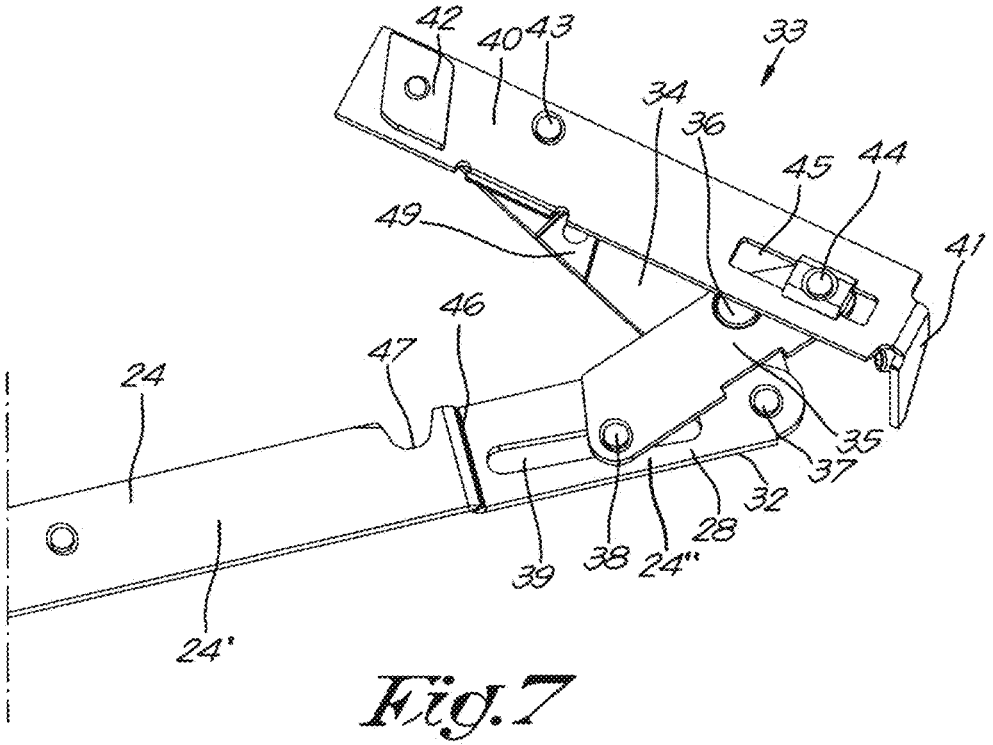
FIG. 7 shows a perspective view of the section that is indicated by the box F7 in FIG. 5.

The scissor mechanism 22 is shown in more detail in its constituent parts in FIG. 3, and essentially comprises a main arm 24 that is hingeably coupled by a first section 24' at its first end 25 to a carriage 26 that is movable in the longitudinal direction of the top profile 7 in a guide 27 that is fastened on this profile 7 across the fitting groove 15 and where the sliding slat 18' is freely movable underneath, as illustrated in FIG. 4.

The sliding slat 18' is provided at its free end with an extension piece 18" with a U-shaped locking piece 28 that can engage with the locking pin 29 that is fastened on the main arm 24 through the movement of the fitting slat 18', to thus be able to block the main arm 24 with respect to the leaf 3 when the locking pin 29 is held in the locking piece 28 in the turn position of the operating handle 19 to thus be able to turn the leaf 3 around the vertical axis X-X', or to be able to unblock it by moving the locking pin 29 from the locking piece 28 in the tilt position of the operating handle 19 to enable the tilting of the leaf 3 around the horizontal axis Y-Y'.

The sliding slat 18' or the extension piece 18" is also provided with a locking peg 30 whose function will be further explained.

The main arm 24 is hingeably connected to the guide 27 by means of a hinge arm 31.

A second section 24" at the second end 32 of the main arm 24 is coupled to a scissor hinge 33 with a pair of scissors with two scissor arms, respectively a first scissor arm 34 and a second scissor arm 35, that are connected together by means of a central hinge 36, whereby the main arm 24 is hingeably connected to an end of each of these scissor arms 34 and 35, respectively by means of a hinge 37 close to the end 32 of the main arm 24 and by means of a hinge pin 38 that is movably held in a slot 39 of the main arm 24 at a distance from the aforementioned end 32 and the hinge 37.

Figure 8:
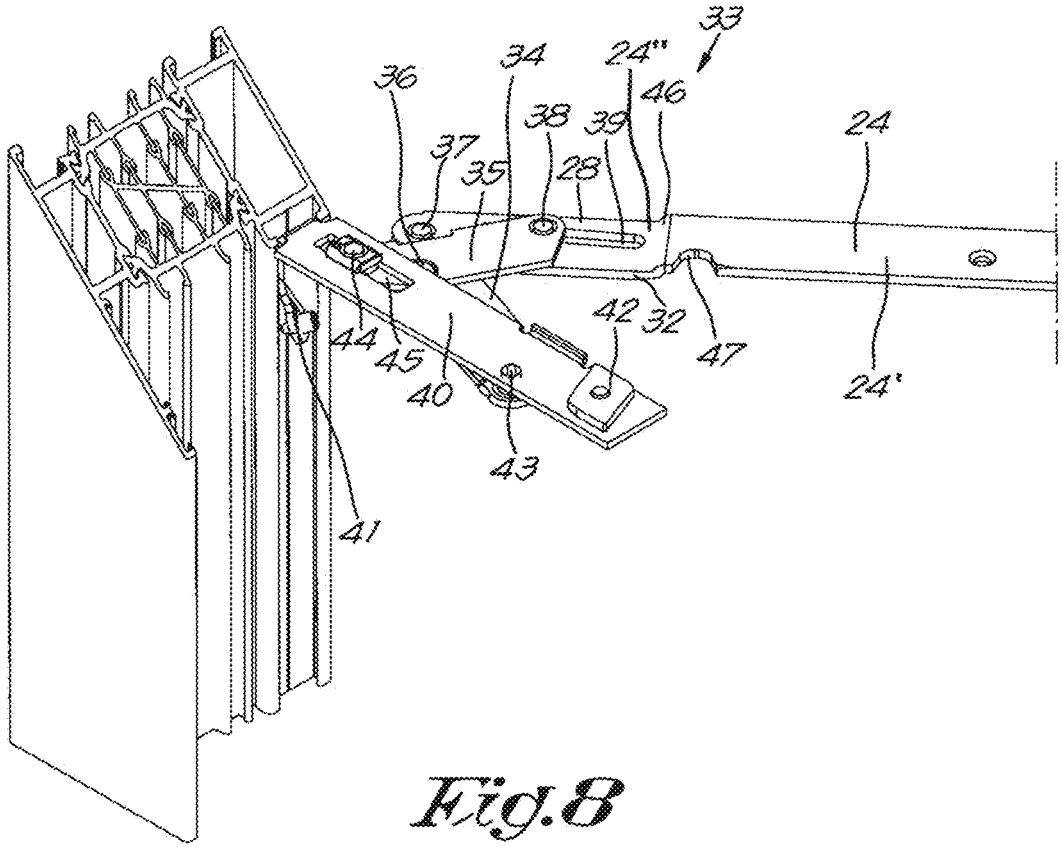
FIG. 8 illustrates how the section of FIG. 7 is mounted in the fixed frame of a window.

The scissor arms 34 and 35 are hingeably connected by their other end to a mounting slat 40 with which the scissor hinge 33 can be mounted on the inside of the frame 2, as shown in FIG. 8, by means of a lip 41 with which the mounting slat 40 can be hooked in an inside corner of the frame in the fitting groove 14 of the frame 2, and a key 42 that can be locked in the fitting groove 14 of the top horizontal profile 6 of the frame 2.

The scissor arms 34 and 35 are connected to the mounting slat 40, respectively by means of a hinge 43 at a distance from the lip 41 and by means of a hinge pin 44 that is movably held in a slot 45 of the mounting slat 40, which is located between the hinge 43 and the lip 41.

A characteristic of the invention is that the main arm 24, counterintuitively, is turnably held by its second end 32 between the two scissor arms 34 and 35, of which the first scissor arm 34 is below the level of the main arm 24 in the mounted state of the concealed hinge 4, while the second scissor arm 35 is above the main arm, more specifically between the main arm 24 and the mounting slat 40.

In order to bring the main arm 24 as close as possible to the mounting slat 40, and thus as close as possible to the top horizontal profile 6 of the fixed frame 2 in order to provide maximum space for the rest of the fittings under main arm 24, this main arm 24 is provided with a double kink 46 towards the top that forms a separation between the aforementioned first section 24' and the aforementioned second section 24" of the main arm 24, whereby in the closed state of the hinge 4 the first section 24' is at a higher level and extends over the guide 27.

Thanks to the fact that the main arm 24 is held by its second section 24" between the scissor arms 34 and 35, this second section 24" is closer to the mounting slat 40 and the top horizontal profile 6 of the fixed frame 2 than with the known applications in which the second section 24" is mounted below the two scissor arms 34 and 35.

As a result the thickness of the double kink 46 that is needed to bring the first section 24' of the main arm 24 up to the level of the second scissor arm 35, that is the closest to the mounting slat 40, can be smaller, which results in the fact that, due to this arrangement, when loaded less bending will occur in the main arm 24 and the leaf 3 is in a more stable tilted position in the event of greater weights of the leaf 3.

In order to leave space for the various hinge points when folding the hinge 4 shut, the following cutaways are provided:

a first cutaway 47 in the back side edge of the main arm 24 for the hinge 43 that is close to the back side edge of the mounting slat 40 and the back side edge of the first scissor arm 34;

a second cutaway 48 in the same back side edge of the main arm 24 for the central hinge 36 that is close to the back side edge of the first scissor arm 34 and the second scissor arm 35; and, a cutaway 49 in the form of a deepening in the first scissor arm 34 for the hinge pin 38, whereby this deepening opens out to the front side edge of this scissor arm 34 and whereby this hinge pin 38 is close to the front side edge of the second scissor arm 35 and close to the front side edge of the main arm 24.

Figure 9:
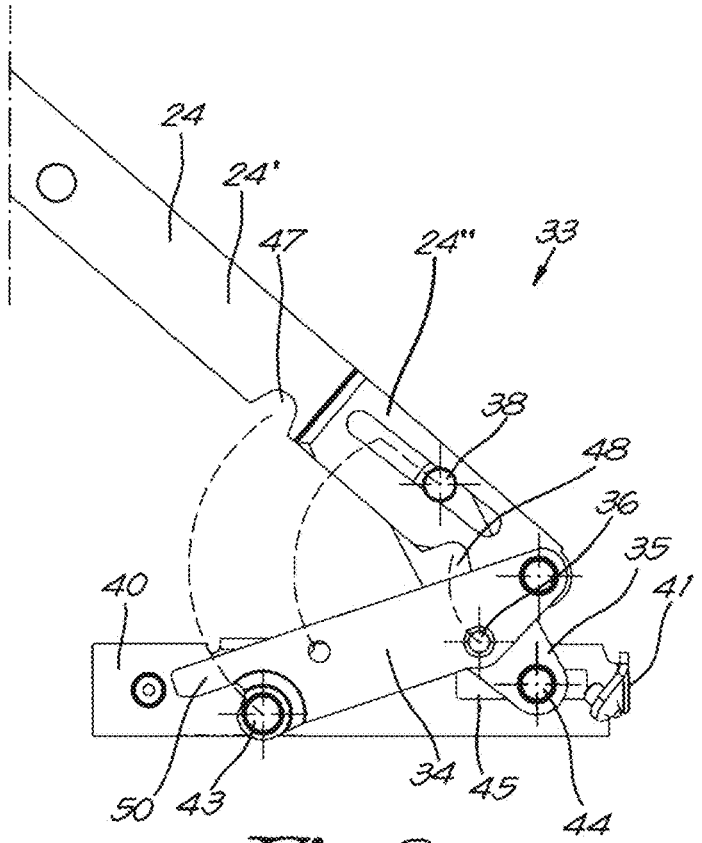
FIG. 9 shows the section indicated by the box F9 in FIG. 6 on a larger scale, but in a more open position.
Figure 10:
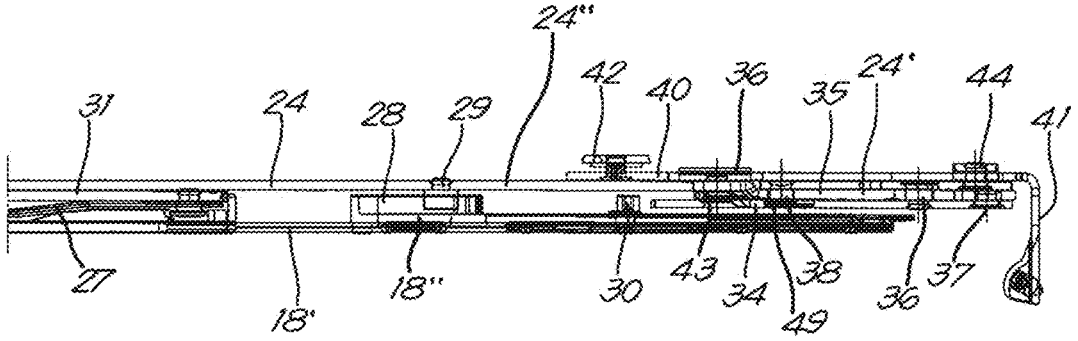
FIG. 10 shows a front view of the concealed hinge of FIG. 3 in an assembled state.
Figure 11:
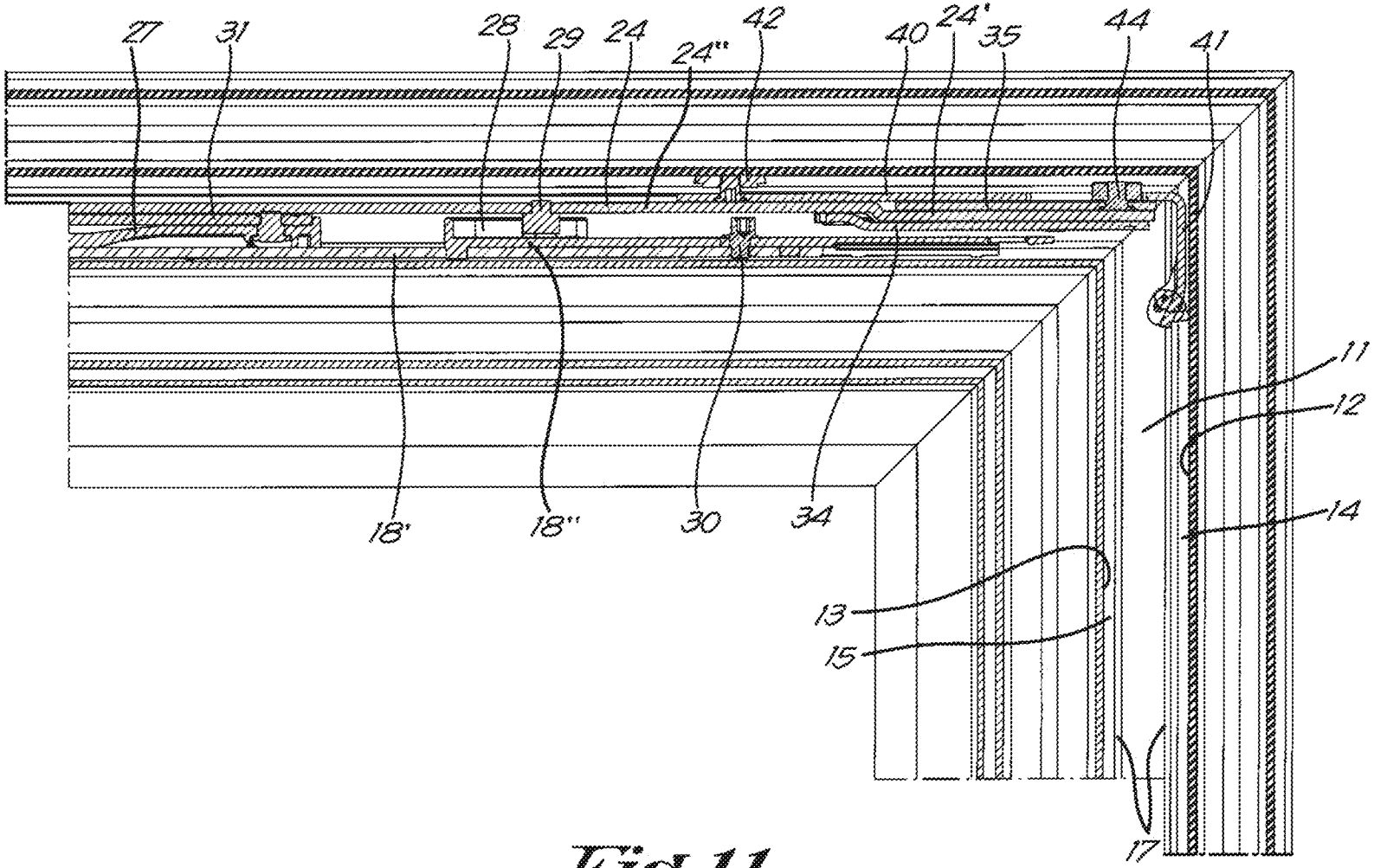
FIG. 11 shows a cross-section according to line XI-XI in FIG. 3, but in a mounted state in a window.

FIG. 9 shows the movements of these hinge points 43, 36 and 38 opposite the cutaways 17, 48 and 49 when closing the concealed hinge 5.

The positions of the turning points and slots are chosen such that despite the various cutaways 43, 36 and 38 the hinge remains strong enough.

The bottom first scissor arm 34 is further provided along its front edge on the tilt side with a longitudinally protruding finger 50 that is affixed eccentrically and behind which the locking peg 30 can hook onto the fitting slat 18' when closing the window 1 due to be closing movement of the operating handle 19.

Figure 12:
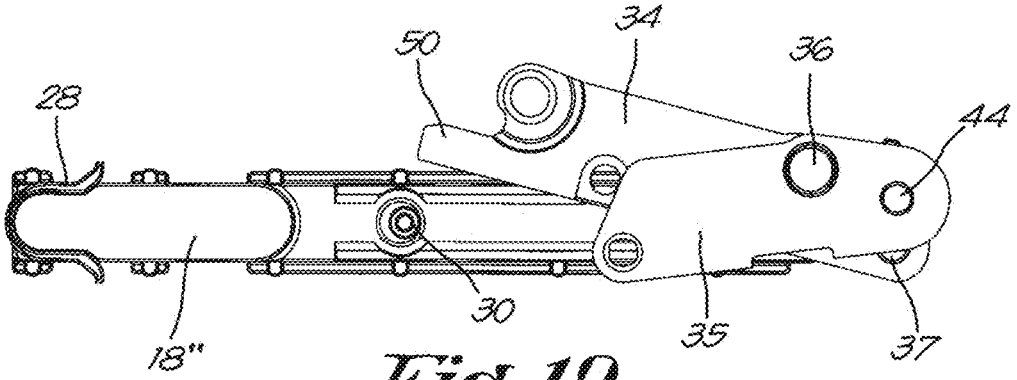
FIGS. 12 to 14 show the section indicated by F7 in FIG. 5 on a larger scale, this in different positions and with the omission of certain parts of the hinge.
Figure 13:
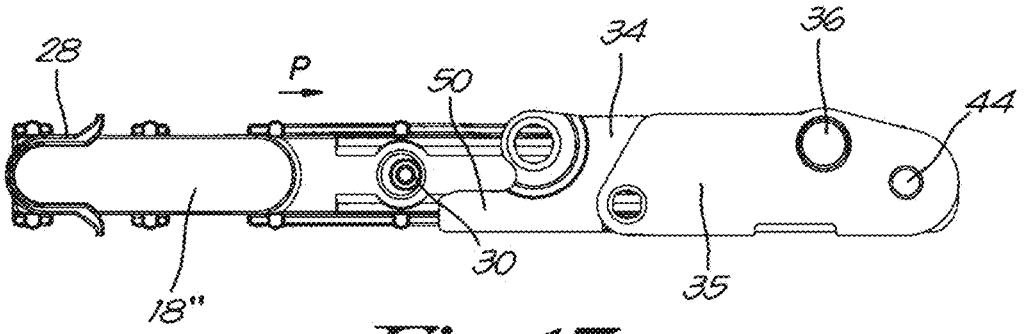
Figure 14:
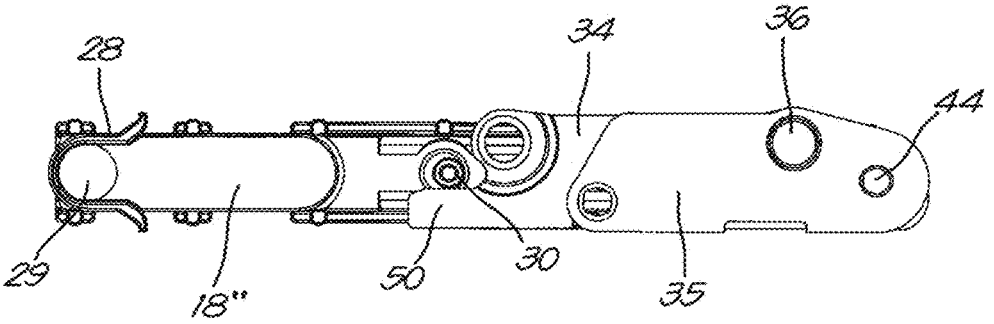

This is illustrated on the basis of FIGS. 12 to 14 in which FIG. 12 shows the situation of a tilted open window, while FIG. 13 shows the situation after the leaf 3 has been pushed back against the fixed frame 2 from its tilted position to a closed state, and the scissor hinge 33 is hereby folded up, and FIG. 14 shows the situation after the operating handle 19 has been turned back to the closed position and as a result the locking peg 30 has moved in the direction of arrow P in FIG. 13 due to the movement of the fitting slat 18', such that the locking peg 30 has hooked behind the finger 50.

From practice it is known that the height of the gap 11 between the fixed frame 2 and the leaf 3 can vary under the influence of various factors such as sawing tolerances in the composition of the profiles 6 and 7 of the frame 2 and the leaf 3, the weight of the leaf 3, the height adjustment of the leaf 3 and similar. The space in which the scissor hinge 31 must fit is thus variable, as well as the vertical clearance between the locking peg 30 and the underside of the main arm 24 and thus also the height that the locking peg 30 protrudes above the finger 50.

Because the main arm 24 is no longer at the bottom, as in the known concealed hinges 4, and because the main arm 24 goes up a level due to the double kink 46, there is more free space between the finger 50 and the underside of the main arm 24, whereby this space can be utilised, for a given height of the locking peg 30, to accommodate a relatively large height difference of the gap 11 without the locking peg 30 coming under the finger 50, such that it could lose its locking function.

An advantage of the invention is that the length of the locking peg 30 can be defined such that the locking function of the locking point 30-50 is always preserved within a relatively large margin of the height of the gap 11 between the frame 2 and leaf 3.

In this way at the location of the scissor hinge 33, an additional locking point 30-50 can be realised in a simple and space-saving way at the top corner on the hinge side of the window 1.

The operation of a window fitting with a top hinge 5 according to the invention is simple and as follows.

If, from the locked situation of FIG. 14, the operating handle 19 is turned from the closed position to the turn position, then the fitting slat 18' together with the locking peg 30 and the locking piece 28 is moved in the opposite direction of the arrow P in FIG. 13, such that the locking point 30-50 is disconnected while the locking pin 29 is still held in the U-shaped locking piece 28 and as a result the scissor mechanism 22 is blocked with respect to the leaf 3, such that in this position of the operating handle 19 the leaf 3 can be turned open around the vertical axis X-X'.

When the operating handle 19 is further turned from this turn position, the locking piece 28 is removed from the locking pin 219 in the opposite direction of arrow P, such that the scissor mechanism is now unblocked and enables the tilting of the leaf around a horizontal axis Y-Y'. In this case it is called a turn-tilt window in view of the order of the turn and tilt functions when turning the operating handle 19.

Figure 15:
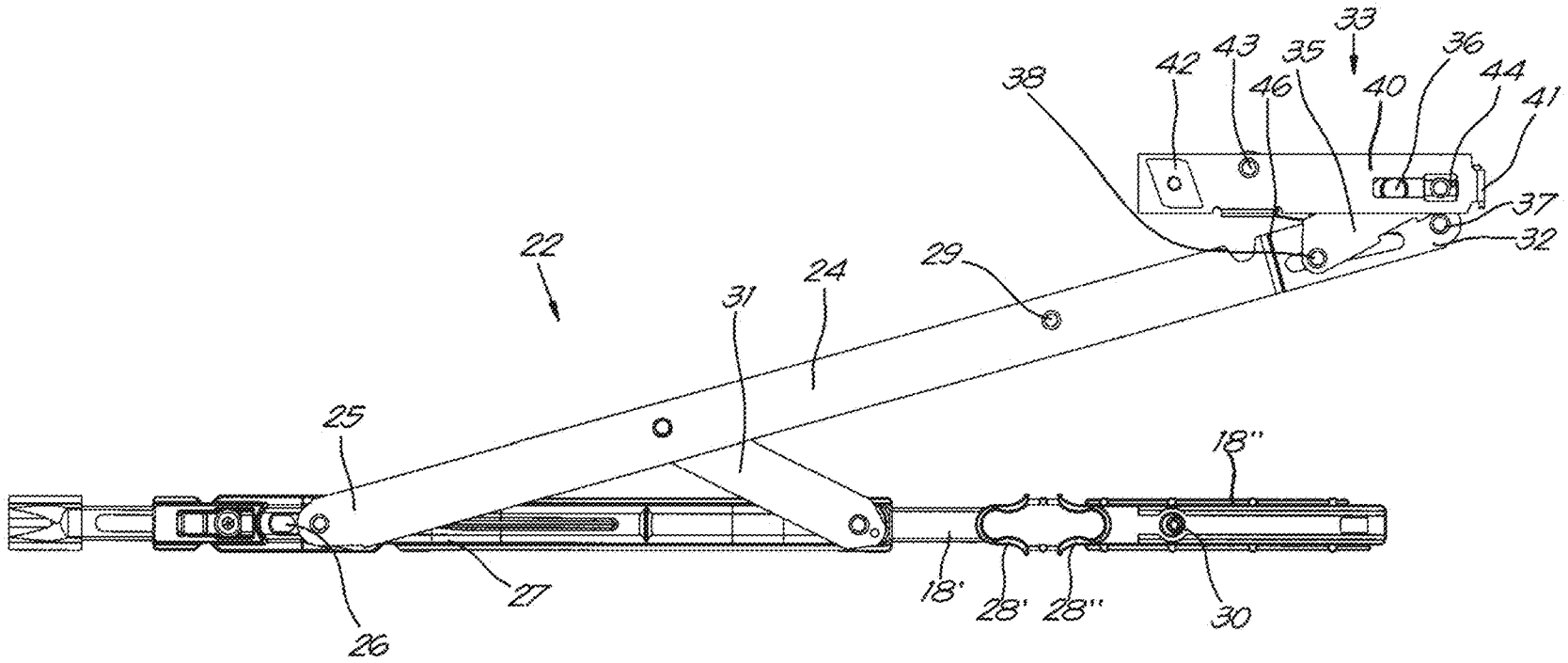
FIG. 15 shows a view such as that of FIG. 4, but of a variant embodiment of a concealed hinge according to the invention.

The variant shown in FIG. 15 differs from the embodiment described above in the fact that two U-shaped locking pieces 28' and 28" are now provided that are oriented with their opening oriented towards one another and which move together with the fitting slat 18'.

In this case it is possible to turn the operating handle 19 from the closed position in the other direction than above, in which case the order of the tilt-turn functions obtained is reversed, and in this case it is a turn-tilt window.

It is clear that the main arm 24 can consist of a number of parts, for example two parts that are detachably connected together at the location of the double link.

The invention is not limited to a concealed hinge with only two scissor arms, but by extension also relates to a concealed hinge with more than two scissor arms that are hingeable with respect to one another, whereby in the folded-up and mounted situation of the concealed hinge the main arm is located with its second section 24" above at least one of the scissor arms.

The present invention is by no means limited to the embodiments described as an example and shown in the drawings, but a concealed hinge according to the invention for a turn-tilt or tilt-turn window and the accompanying components can be realised in all kinds of forms and dimensions without departing from the scope of the invention.

The invention claimed is:

1. A concealed hinge for a tiltable window with a fixed frame and a leaf, the concealed hinge comprising:

a scissor mechanism with a main arm, the main arm including a first section provided at a first end with a first section hinge configured to fasten the concealed hinge to a top of the leaf, and a second section hingeably connected at a second end to a scissor hinge that is configured to hingeably connect the main arm to the fixed frame, the scissor hinge including at least two scissor arms that are hingeable with respect to one another such that the concealed hinge is configured to be folded up to a folded-up position in which the main arm and the scissor arms are disposed above one another and essentially parallel to one another in a horizontal direction, in the folded up position of the concealed hinge, the main arm with the second section at the second end thereof is located between two of the at least two scissor arms.

2. The concealed hinge according to claim 1, wherein the first section hinge is affixed on a carriage at the first end of the main arm that is movably affixed in a guide that is configured to fasten the concealed hinge on the top of the leaf, the scissor arms being hingeably connected by one end to the main arm and being hingeably connected by another end to a mounting slat with which the scissor hinge is able to be fastened to an inside of the fixed frame.

3. The concealed hinge according to claim 2, wherein the guide is provided to allow a fitting slat to pass underneath the guide in relation to a position of the scissor mechanism in relation to the fitting slat, the fitting slat or an extension piece for fitting slat being provided with a U-shaped locking piece configured to engage with a locking pin, due to a movement of the fitting slat or the extension piece, that is fastened on the main arm to thus be able to block or unblock the main arm with respect to the fitting slat or the extension piece.

4. The concealed hinge according to claim 3, wherein the fitting slat or the extension piece is provided with two U-shaped locking pieces that are oriented with their openings towards one another and which are at a distance from one another, the locking pieces being configured to both engage with the locking pin on the main arm.

5. The concealed hinge according to claim 3, wherein the first scissor arm is provided along its front edge with a longitudinally protruding finger, the fitting slat or the extension piece being provided with a locking peg configured to engage with the finger to form a locking point at the location of the scissor hinge.

6. The concealed hinge according to claim 5, wherein the finger is eccentrically affixed on the first scissor arm.

7. The concealed hinge according to claim 2, wherein the mounting slat is provided with a lip with which the mounting slat is configured to be hooked in a vertical fitting groove of the fixed frame on a hinge side of the window.

8. The concealed hinge according to claim 7, wherein the mounting slat is provided with a key with which the mounting slat is configured be fastened in a horizontal fitting groove of the frame, the key being at a distance from the lip.

9. A tiltable window with a fixed frame and a turnable leaf therein, the window comprising:

the concealed hinge according to claim 2, the guide being fastened to the top of the leaf and the mounting slat is mounted in an inside corner of the fixed frame, against an inside of a top horizontal profile of the fixed frame.

10. The tiltable window according to claim 9, wherein the leaf is provided along an outer periphery thereof with a fitting groove in which fitting slats are movably affixed that configured to be moved by an operating handle, and the guide is mounted across the fitting groove of the leaf with one of the fitting slats.

11. The tiltable window according to claim 10, wherein the one fitting slat is provided on the top of the leaf or an extension piece thereof with a locking piece that is configured to engage with a main arm peg of the main arm, and with a locking peg configured to engage with the first scissor arm to form a locking point.

12. The concealed hinge according to claim 2, wherein the main arm is provided with a step between the first section and the second section of the main arm, and in the folded-up position of the concealed hinge, the first section is located at a different step level than a step level of the second section due to the step.

13. The concealed hinge according to claim 1, wherein the main arm is provided with a step between the first section and the second section of the main arm, and in the folded-up position of the concealed hinge, the first section is located at a different step level than a step level of the second section due to the step.

14. The concealed hinge according to claim 13, wherein in the folded-up position of the concealed hinge, the higher first section of the main arm is at approximately the same height as the scissor arm that is the closest to the mounting plate, of the at least two scissor arms.

15. The concealed hinge according to claim 1, wherein the at least two scissor arms comprise two scissor arms, including a first underlying scissor arm and a second overlying scissor arm, the main arm being hingeably connected to an end of each of the two scissor arms, respectively by a hinge close to the second end of the main arm and by a hinge pin that is moveably held in a slot of the main arm that is located between the hinge connected at the second end of the main arm and a kink.

16. The concealed hinge according to claim 15, wherein the slot in the main arm for the hinge pin is located close to a front side edge of the main arm, the hinge pin is located close to a front side edge of the second scissor arm, and a cutaway is provided in the first scissor arm for the hinge pin in the form of a groove that opens out to the front side edge of the first scissor arm.

17. The concealed hinge according to claim 15, wherein the first scissor arm is connected to a mounting slat by a first scissor arm hinge and the second scissor arm is connected to the mounting slat by a hinge pin that is movably held in a slot of the mounting slat that is located at a distance from the first scissor arm hinge of the first scissor arm.

18. The concealed hinge according to claim 17, wherein the first scissor arm hinge is located between the mounting slat and the first scissor arm close to a back side edge of the mounting slat and close to a back side edge of the first scissor arm, and a first cutaway is provided for first scissor arm hinge in the back side edge of the main arm.

19. The concealed hinge according to claim 15, wherein the at least two scissor arms are connected together by a central hinge that is close to a back side edge of the first scissor arm and of the second scissor arm, and the main arm is provided on a back side edge with a second cutaway for the central hinge.

20. The concealed hinge according to claim 1, wherein the scissor mechanism comprises an additional hinge arm, in addition to the main arm, that is hingeably connected by an end to the first section of the main arm and is hingeably connected by another end to the guide.

* * * * *